US005597972A

United States Patent [19]

Wachter

[11] Patent Number: 5,597,972

[45] Date of Patent: Jan. 28, 1997

[54] EXPLOSIVE POWDER CHARGE OPERATED SETTING TOOL WITH A MAGAZINE FOR FASTENING ELEMENTS

[75] Inventor: Hannes Wachter, Vandans, Austria

[73] Assignee: Hilti Aktiengesellschaft, Schaan, Liechtenstein

[21] Appl. No.: 647,549

[22] Filed: May 15, 1996

[30] Foreign Application Priority Data

May 15, 1995 [DE] Germany ..... 195 17 230.2

[51] Int. Cl.[6] ..... B25C 1/14

[52] U.S. Cl. ..... 89/1.14; 227/10

[58] Field of Search ..... 89/1.14; 227/10, 227/11, 9; 42/11

[56] References Cited

U.S. PATENT DOCUMENTS

| | | | |
|---|---|---|---|
| 3,863,824 | 2/1975 | Bakoledis | 227/10 |
| 4,741,467 | 5/1988 | Gassner et al. | 227/10 |
| 4,930,673 | 6/1990 | Pfister | 227/10 |

FOREIGN PATENT DOCUMENTS

| | | | |
|---|---|---|---|
| 330953 | 9/1989 | European Pat. Off. | 227/9 |
| 3806626 | 9/1989 | Germany | 227/9 |

*Primary Examiner*—Stephen M. Johnson
*Attorney, Agent, or Firm*—Anderson Kill & Olick P.C.

[57] ABSTRACT

An explosive powder charge operated setting tool includes a housing (1) with a bolt guide (2) projecting axially outwardly from its leading end in the setting direction. The bolt guide (2) is axially displaceably relative to the housing. A magazine (5) for fastening elements (6) is mounted on the bolt guide (2) and is displaceable relative to the bolt guide counter to the setting direction against the force of a first spring (11) positioned between the bolt guide and the magazine. A second spring (13) is located between the housing (1) and the magazine (5) and has a maximum force in the setting direction and a spring travel each greater than the spring force and travel of the first spring (11).

7 Claims, 3 Drawing Sheets

EXPLOSIVE POWDER CHARGE OPERATED SETTING TOOL WITH A MAGAZINE FOR FASTENING ELEMENTS

BACKGROUND OF THE INVENTION

The present invention is directed to an explosive powder charge operated setting tool including a housing with a bolt guide projecting from a leading end of the housing with the bolt guide axially displaceable relative to the housing. A magazine for fastening elements extends laterally from the bolt guide and can be displaced relative to the bolt guide against the force of a spring counter to the setting direction of the setting tool.

Hilti Aktiengesellschaft markets an explosive powder charge operated setting tool with a magazine for fastening elements characterized as model X A41 X AM 72. A bolt guide mounting a magazine projects from the housing of this known setting tool. The magazine can be moved relative to the bolt guide parallel to the setting direction. A spring in the form of an annular spring is located between the magazine and the bolt guide and the spring presses the magazine against a shoulder of the bolt guide facing in the setting direction and shaped basically in a circumferentially extending manner. The magazine located at the bolt guide enables storage and automatic feed of a number of consecutively arranged fastening elements, such as nails or studs, positioned in guide bushings connected to one another in a belt-like manner. A spring-loaded slide serves for feeding the attachment members within the magazine towards the bolt guide.

The housing must be moved though a so-called "contact pressure travel" relative to the bolt guide so that the setting tool can be operated. Accordingly, in a first phase of the contact pressure travel a leading end of the bolt guide is pressed against the surface of a receiving material. During the displacement of the bolt guide along with a piston guide located adjacent the bolt guide, a firing arrangement located in the trailing end region of the housing is cocked, the firing arrangement can be actuated by a switch or trigger. In a second phase of the contact pressure travel a displacement of the magazine relative to the bolt guide takes place in the setting direction, until the magazine also contacts the surface of the receiving material. This second phase loads a spring effective between the bolt guide and the magazine.

After a fastening element has been driven into the receiving material, the driving piston returns to its original position by means of stored waste gasses developed by the explosive powder charge. After the setting process, the waste gasses flow through an appropriate opening from a storage space into the inside of the piston guide upstream of the leading end face of the piston. The waste gasses return the driving piston back into its original position.

When the setting tool is lifted off the receiving material following firing, the housing is displaced relative to the piston guide and the bolt guide. The prestressed spring acting between the bolt guide and the magazine displaces the magazine relative to the bolt guide into its original position. After the magazine has returned to its original position, another fastening element can be pushed into the bolt guide from the magazine through an opening located in the side of the bolt guide.

Since the axial displacement of the magazine relative to the bolt guide is small, the feed of another fastening element takes place directly after the setting tool has been lifted off the receiving material and directly after the driving piston has been accelerated into its original position by the stored waste gasses.

If a magazine containing long fastening elements is used, damage can occur in the region formed by the magazine of the bolt guide and also in the region of the setting direction side of the piston rod of the driving piston. When longer fastening elements are being driven, the working stroke of the driving piston is correspondingly longer and the explosive powder charge used is stronger, so that the waste gasses build up a greater pressure in the storage unit. The greater pressure causes a strong acceleration of the driving piston into its original position, so that it can rebound several times in the firing region and move in the setting direction until it is finally located in its original position by the residual pressure of the storage unit. In the course of the rebound of the driving piston, it can impact with its piston rod against a fastening element which is pushed at this particular point in time from the magazine to the bolt guide and is not yet completely housed in the bolt guide.

SUMMARY OF THE INVENTION

The primary object of the present invention is to provide an explosive powder charge operated setting tool with a magazine for fastening elements where the feed of the fastening elements can be controlled as a function of the position of the housing relative to the magazine. In accordance with the present invention, a second spring is located between the housing and the magazine having a maximum force acting in the setting direction and a corresponding spring travel greater than the force and spring travel of a first spring acting between the bolt guide and the magazine.

The second spring located between the magazine and the housing comes into contact with a face of the housing directed in the setting direction during the initial phase of the contact pressure travel and moves the magazine relative to the bolt guide in the setting direction, because of the longer spring travel and greater force, until it moves into contact with the receiving material. As a result, a prestress of the first spring disposed between the magazine and the bolt guide having the smaller spring travel and the lesser force compared to the second spring is developed. This force provided by the first spring and acting counter to the contact pressure travel causes at least a slight deformation of the second spring. The first spring develops the greatest force possible at the latest during the second phase of the contact pressure travel, when the second spring has been further compressed.

After the setting process has been completed, the setting tool is lifted off the surface of the receiving material. At this time a displacement of the bolt guide together with the piston guide takes place relative to the housing along with a displacement of the magazine relative to the bolt guide. Only when the magazine has been moved relative to the bolt guide to such an extent that the second spring is no longer in contact with the housing, there occurs a movement of the magazine relative to the bolt guide lasting until the magazine has assumed its original position.

The second spring located in the magazine projects beyond the magazine opposite the setting direction so that it is able to achieve a good contact between the housing and the second spring.

Preferably, the second spring is a compression spring for reasons of fabrication and economy.

A slide in which the compression spring is positioned, is displaceable parallel to the magazine and serves for the rapid and secure attachment of the second spring to the magazine.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and describe a preferred embodiment of the invention.

DETAILED DESCRIPTION OF THE INVENTION

Figure 1:
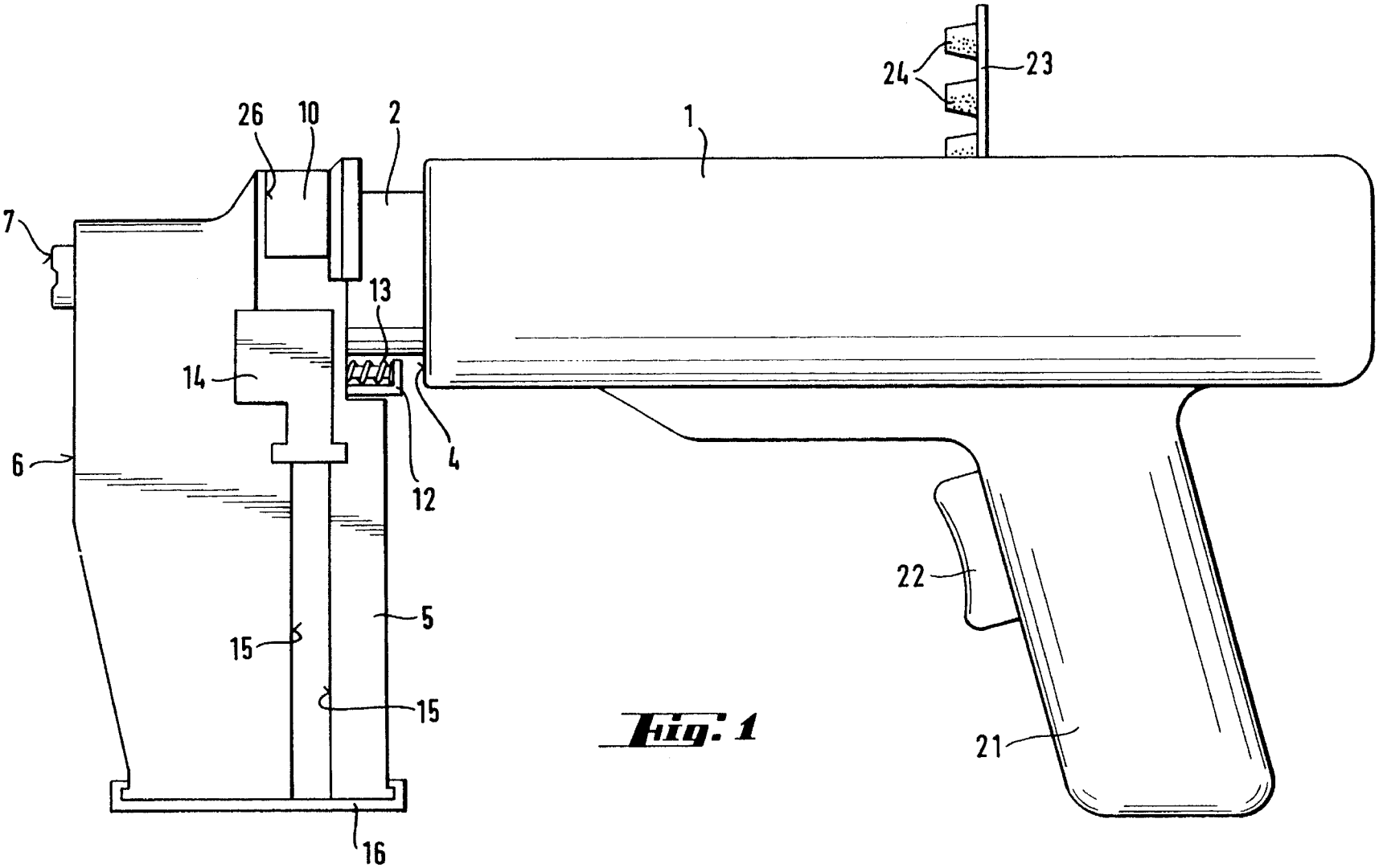
FIG. 1 is a side elevational view of an explosive powder charge operated setting tool embodying the present invention and illustrated in an at rest position.

In FIG. 1 an explosive powder charge operated setting tool is shown with a housing 1 having a leading end at its left hand end and a trailing end at its right hand end. An axially extending bolt guide 2 projects in the setting direction from the leading end of the housing. In its trailing end region, the housing 1 has a handle 21 projecting downwardly. A trigger 22 for actuating the setting process is located in the handle 21. A carrier strip 23 extends upwardly from the top of the housing 1 and is movable into the housing containing several explosive powder charges 24 disposed one following the other in the carrier strip. A magazine for the fastening elements 8 is mounted on the bolt guide 2 and is displaceable relative to the bolt guide. Note that the magazine 5, as shown in FIG. 1, is located in the setting direction ahead of the leading end face 4 of the housing 1.

Figure 2:
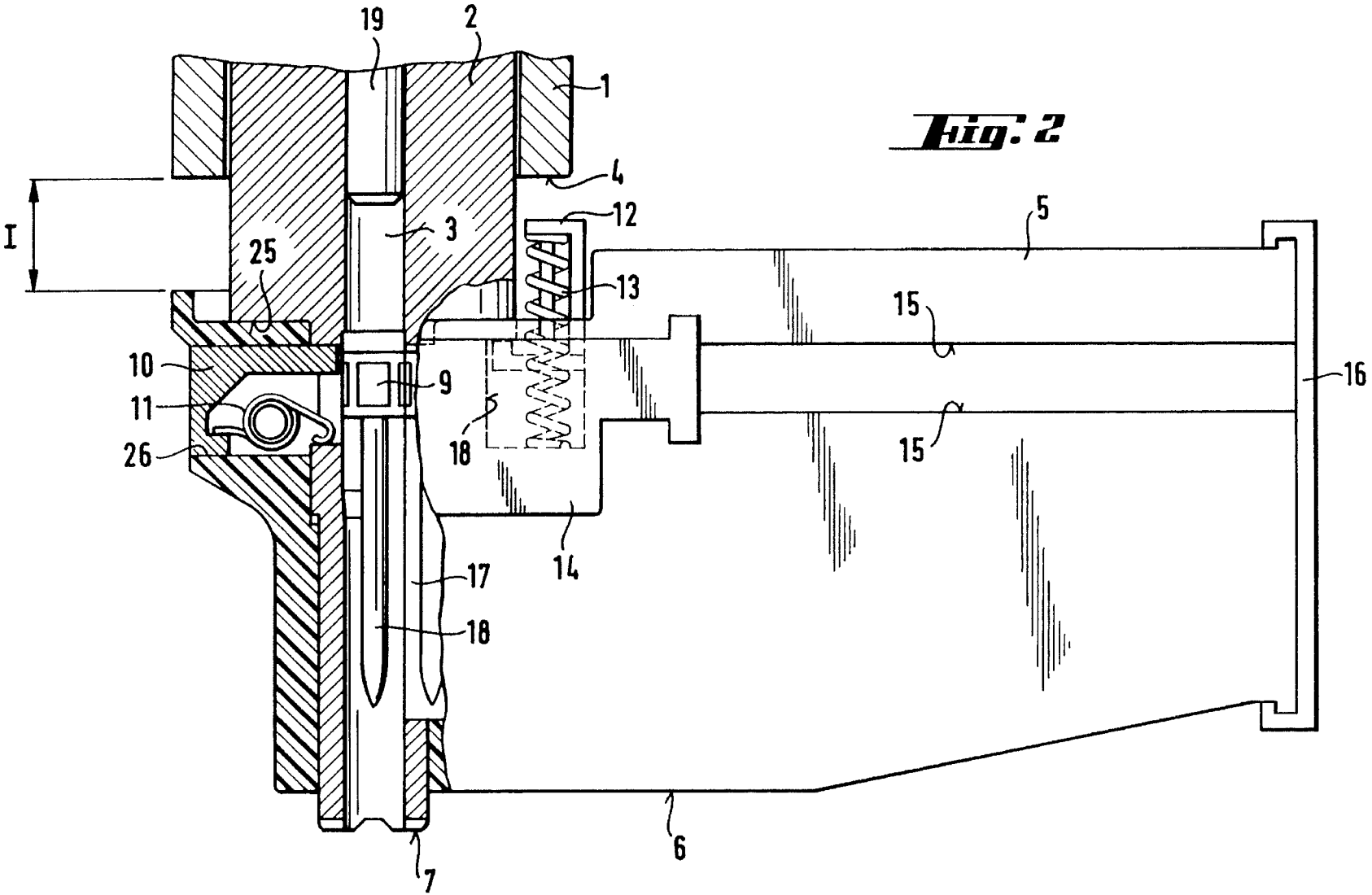
FIG. 2 is an enlarged partial view of the leading end region of the setting tool shown in FIG. 1 in the rest position and shown partially in section.
Figure 3:
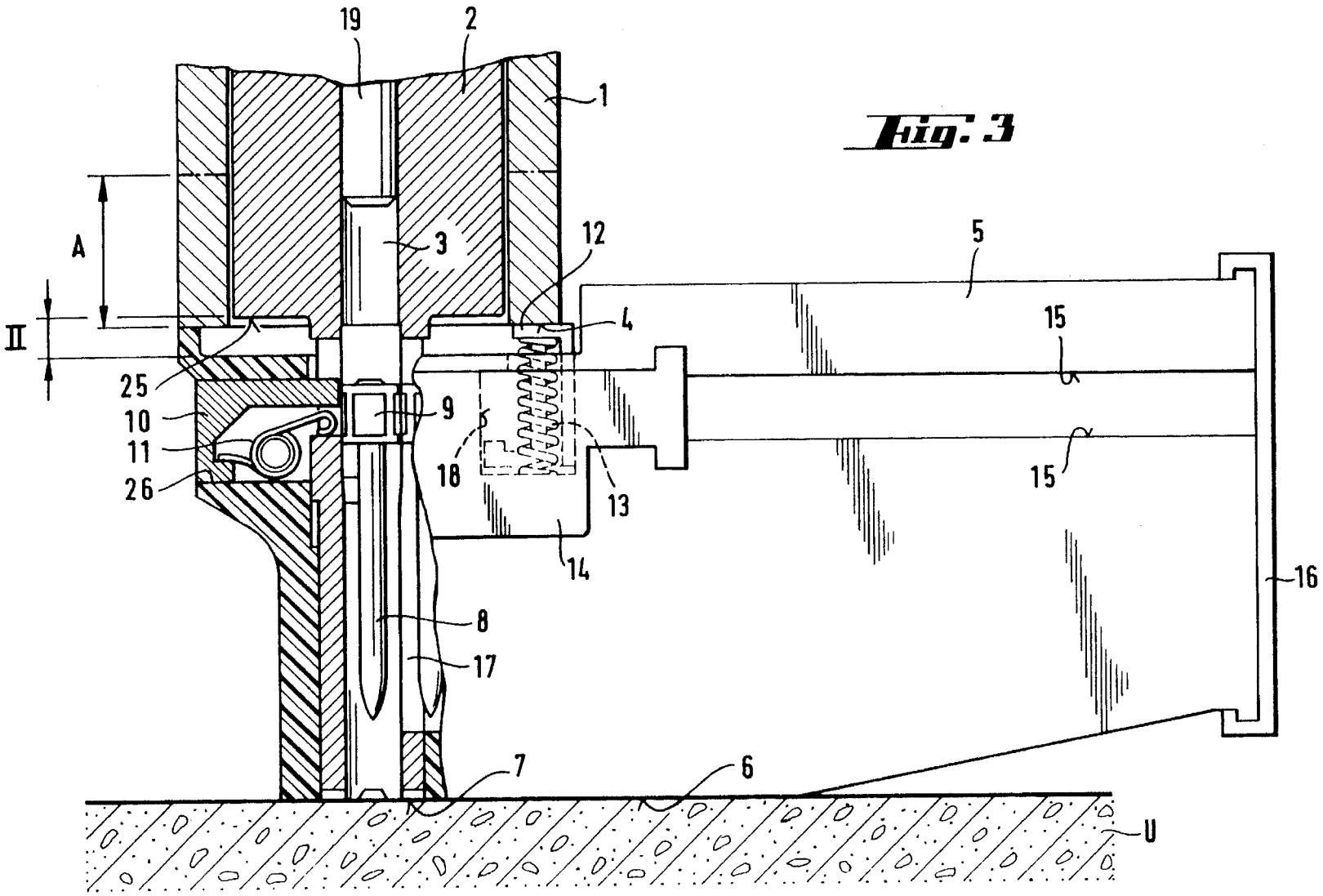
FIG. 3 is a view similar to that shown in FIG. 2, however, with the setting tool exerting a contact pressure against the surface of a receiving material.

As can be seen in FIGS. 2 and 3, the fastening elements 8 such as nails or studs, are retained in guide bushings 9 connected together in a belt-like manner. The interior of the magazine is accessible through a cover 16 on an end of the magazine 5 spaced outwardly from the bolt guide. A spring-loaded sliding carriage 14 serves for automatic feed of the fastening elements 8 in the magazine towards the bolt-guide and the sliding carriage is displaceable along guides 15 in the magazine. The fastening elements 8 move from the magazine 5 into the guide channel 3 in the bolt guide 2 through a passage 17 in the bolt guide.

As displayed in FIGS. 2 and 3, the magazine 5 bears against a shoulder 25 of the bolt guide 2 facing in the setting direction and extending circumferentially. The magazine is displaceable in the setting direction against the force of a first spring 11 located between the bolt guide 2 and the magazine 5. The spring 11 is shaped as a torsion spring and engages a lug-shaped projection in an insert 10 located in a recess 26 in the magazine 5 and the insert 10 is seated in the recess 26 parallel to the setting direction.

To enable the actuation of the setting tool, the bolt guide and a piston guide, not shown, adjacent to the bolt guide must be displaced relative to the housing through a contact pressure travel A, note FIG. 3, so that a firing arrangement, not shown, located in the trailing end region of the housing 1 can be cocked. For this purpose, as shown in FIG. 2, a leading end pressure face 7 of the bolt guide 2 is placed on the surface of a receiving material U and is pressed toward the receiving material. The contact pressure travel A is sub-divided so that in a first or initial phase I, the bolt guide and the piston guide, not shown, are displaced while cocking the firing arrangement and only in the second phase II, note FIG. 3, the magazine is finally pressed with its contact face 6 against the surface of the receiving material U.

A second spring 13 located in the magazine 5 and extending toward the leading end face 4 of the housing 1, establishes, during the first phase I of the contact pressure travel, contact with the leading end phase 4 of the housing and displaces the magazine 5 in the setting direction relative to the bolt guide until it contacts the surface of the receiving material U. During such movement, the first spring 11 is prestressed between the magazine 5 and the bolt guide 2 with the spring 11 having a shorter spring travel and a lower spring force compared to the second spring 13. The second spring 13 is compressed further at the latest during the second phase II of the contact pressure travel.

The second spring 13 is a compression spring mounted in a slide 12 for preventing any sideways deviation or yielding of the second spring. The slide 12 is positioned in a recess 18 and is axially displaceable therein. During the contact pressure travel, the slide 12 moves into contact with the leading end face 4 of the housing 1 and is pushed further into the recess 18. The second spring 13 is compressed by the slide in the recess 18 and is prestressed.

After a driving piston 19 in the guide channel 3 drives a fastening element into the receiving material U, the setting tool is lifted off the surface of the receiving material.

As the setting tool is removed, a displacement of the bolt guide 2 relative to the housing 1 and a displacement of the magazine 5 relative to the bolt guide 2 takes place. Only when the housing 1 has been moved a sufficient distance from the receiving material relative to the bolt guide 2, the second spring 13 no longer exerts any force on the magazine 5 and a displacement of the magazine relative to the bolt guide occurs until the magazine has assumed its original position at the shoulder 25 of the bolt guide 2.

While specific embodiments of the invention have been shown and described in detail to illustrate the inventive principles, it will be understood that the invention may be embodied otherwise without departing from such principles.

I claim:

1. Explosive powder charge operated setting tool comprising a housing (1) having a leading end a trailing end and a setting direction extending in the trailing end to the leading end, a bolt guide (2) extending axially in the setting direction being mounted in and projecting axially from the leading end of said housing, said bolt guide (2) being axially displaceable relative to said housing (1), a magazine (5) for fastening elements mounted on said bolt guide (2) adjacent the leading end of said housing (1) and extending transversely of the axial direction of said bolt guide (2), said magazine (5) being displaceable counter to the setting direction against a force of a first spring (11) relative to said bolt guide (2), said first spring (11) having a spring travel in the setting direction, a second spring (13) mounted in said magazine and arranged to extend between said magazine and said housing, said second spring (13) having a maximum force acting in the setting direction and a corresponding spring travel greater than the spring force and travel of said first spring (11).

2. Explosive powder charge operated setting tool, as set forth in claim 1, wherein said second spring (13) being mounted in said magazine (5) and projecting therefrom counter to the setting direction toward said housing (1) in an at rest position of said tool and being displaceable toward said housing as said tool is placed in a cocked position.

3. Explosive powder charge operated setting tool, as set forth in claim 1 or 2, wherein said second spring (13) being a compression spring.

4. Explosive powder charge operated setting tool, as set forth in claim 3, wherein said second spring (13) is mounted in a slide 12 displaceable in said magazine parallel to the setting direction.

5. Explosive powder charge operated setting tool, comprising a housing (1) having a leading end a trailing end and a setting direction extending in the trailing end to the leading end, a bolt guide (2) extending axially in the setting direction and being mounted in and projecting axially from the leading end of said housing, said bolt guide (2) being axially displaceable relative to said housing (1), a magazine (5) for fastening elements being mounted on said bolt guide (2) adjacent the leading end of said housing (1) and extending transversely of the axial direction of said bolt guide (2), said magazine (5) being displaceable counter to the setting direction against the force of a first spring (11) relative to said bolt guide (2), said first spring having a spring travel in the setting direction, said magazine (5) having a recess therein facing the leading end of said housing, a second spring (13) mounted in said magazine in said recess and arranged to extend between said magazine and said housing, said setting tool having an at rest position and a cocked position, said second spring (13) being in a spaced position from said housing in the at rest position and being in contact with said housing in the cocked position, said second spring (13) having a maximum force acting in the setting direction and a corresponding spring travel each greater than the spring travel and force of said first spring (11).

6. Explosive powder charge operated setting tool, as set forth in claim 5, wherein said second spring (13) being a compression spring.

7. Explosive powder charge operated setting tool, as set forth in claim 6, wherein a slide being mounted in said recess and supporting said second spring (13), said slide being spaced from the leading end of said housing in the at rest position and being in contact with said housing in the cocked position.

* * * * *